US007514150B2

(12) United States Patent
Spencer et al.

(10) Patent No.: US 7,514,150 B2
(45) Date of Patent: Apr. 7, 2009

(54) ENVIRONMENTALLY COMPATIBLE ADDITIVES FOR AQUEOUS LUBRICANTS

(75) Inventors: Nicholas D. Spencer, Zollikon (CH); Seunghwan Lee, Zurich (CH)

(73) Assignee: Eidgenossische Technische Hochschule Zurich, Zurich (CH)

( * ) Notice: Subject to any disclaimer, the term of this patent is extended or adjusted under 35 U.S.C. 154(b) by 84 days.

(21) Appl. No.: 10/511,121

(22) PCT Filed: Apr. 15, 2003

(86) PCT No.: PCT/US03/11868

§ 371 (c)(1),
(2), (4) Date: Mar. 28, 2005

(87) PCT Pub. No.: WO03/089551

PCT Pub. Date: Oct. 30, 2003

(65) Prior Publication Data

US 2005/0164895 A1 Jul. 28, 2005

Related U.S. Application Data

(60) Provisional application No. 60/373,161, filed on Apr. 16, 2002.

(51) Int. Cl.
*B32B 33/00* (2006.01)

(52) U.S. Cl. ..... 428/426; 428/543; 428/446; 428/457

(58) Field of Classification Search ..... 428/543, 428/426, 446, 457
See application file for complete search history.

(56) References Cited

U.S. PATENT DOCUMENTS

| | | | | |
|---|---|---|---|---|
| 5,462,990 | A | 10/1995 | Hubbell et al. | |
| 5,536,573 | A | 7/1996 | Rubner et al. | |
| 5,627,233 | A | 5/1997 | Hubbell et al. | |
| 5,726,230 | A * | 3/1998 | Murata et al. | 524/308 |
| 6,548,460 | B1 * | 4/2003 | Higai et al. | 508/465 |
| 6,741,937 | B2 * | 5/2004 | Waldman et al. | 702/23 |
| 2002/0090616 | A1 * | 7/2002 | Singh et al. | 435/6 |
| 2002/0133297 | A1 * | 9/2002 | Yang et al. | 702/19 |
| 2002/0143081 | A1 * | 10/2002 | Li et al. | 523/201 |
| 2003/0087111 | A1 * | 5/2003 | Hubbell et al. | 428/457 |

FOREIGN PATENT DOCUMENTS

| | | |
|---|---|---|
| WO | WO 98/47948 | 10/1998 |
| WO | WO 00/65352 | 11/2000 |

OTHER PUBLICATIONS

Toshiaki, electronic translation of JP 2002-060772.*

Basu et al., "Fretting wear behavior of $TiB_2$-based materials against bearing steel under water and oil lubrication" *WEAR,* 250: 631-41(2001).

Chen et al., "The difference in running-in period and friction coefficient between self-mated $Si_3N_4$ and SiC under water lubrication" *Tribology Letters,* 11(1): 23-28 (2001).

Duan and Lei, "The effect of particle size on the lubricating properties of colloidal polystyrene used as water based lubrication additive" *WEAR,* 249(5-6): 528-32 (2001).

Francisco et al., "Multilevel solution of the elastohydrodynamic contact for the water lubricated silicon carbide 3D line contact" *Tribology Transactions,* 45(1): 110-16 (2002).

Hollinger et al., "High-pressure lubrication with lamellar structures in aqueous lubricant" *Tribology Letters,* 9(3-4): 143-151 (2000).

Jay et al., "Comparison of the boundary-lubricating ability of bovine synovial fluid, lubricin, and healon" *J. Biomed. Mat. Res.,* 40(3): 414-418 (1998).

Lei et al., "Tribological behavior of fullerene-styrene sulfonic acid copolymer as water-based lubricant additive" *WEAR,* 252(3-4): 345-50 (2002).

Plaza et al., "Tribological performance of some polyoxyethylene dithiophosphate derivatives water solutions" *WEAR,* 249 (12): 1077-89 (2001).

Ratoi-Salagean et al., "The design of lubricious oil-in-water emulsions" *Proceedings Inst. Mech. Engin. Part J: Journal Engin. Tribology,* 211(J): 195-208 (1997).

Ratoi-Salagean et al., "Optimizing film formation by oil-in-water emulsions" *Tribology Transactions,* 40(4): 569-78 (1997).

Regenauer-Lieb et al., "The initiation of subduction: Criticality by addition of water?" *Science,* 294(5542) 578-80 (2001).

Saito et al., "Chemical wear of sintered $Si_3N_4$ hBN and $Si_3N_4$-hBM composites by water lubrication" *WEAR,* 247(2): 223-20 (2001).

Schwarz and Hills, "Surface-active phospholipids as the lubricating component of lubricin" *Brit. J. Rheumatology,* 37(1): 21-26 (1998).

Smith et al., "Does additional lubrication affect condom slippage and breakage?" *Int. J. STD &AIDS,* 9(6):330-335 (1998).

Veith, "Tire wet traction—Explaining performance variation using the 'criticality' concept" *Rubber Chem. Technol.,* 69(5): 858-73 (1996).

Wang et al., "Study of the key problems in a water hydraulic piston pump and its applications" *Indust. Lubric. and Tribology,* 53(5): 211-16 (2001).

(Continued)

*Primary Examiner*—Jeffrey C Mullis
(74) *Attorney, Agent, or Firm*—Pabst Patent Group LLP

(57) ABSTRACT

Lubricating compositions, containing non-modified and modified multifunctional, polyionic copolymers and an aqueous lubricating medium, and methods for making and using such compositions are described herein. The lubricating compositions are applied to metal oxide surfaces, which are in contact with each other. The copolymers can serve as a surface protective boundary layer for the sliding surfaces, or they can also be used for the immobilization of further molecules, which can modify the tribological properties of the surfaces.

20 Claims, 8 Drawing Sheets

OTHER PUBLICATIONS

Widmer et al., "Influence of polymer surface chemistry on frictional properties under protein-lubrication conditions: implications for hip-implant design" *Tribology Letters,* 10(1-2): 111-16 (2001).

Xiong and GE, "Friction and wear properties of UHMWPE/$Al_2O_3$ ceramic under different lubricating conditions" *WEAR,* 250: 242-45 (2001).

* cited by examiner

ENVIRONMENTALLY COMPATIBLE ADDITIVES FOR AQUEOUS LUBRICANTS

PRIORITY CLAIM

This application claims priority to U.S. Ser. No. 60/373,161, entitled "Environmentally Compatible Additives For Aqueous Lubricants", filed Apr. 16, 2002.

BACKGROUND OF THE INVENTION

The present invention is generally in the field of tribology and specifically relates to applying lubricating compositions to surfaces to reduce the friction coefficient and wear on the surfaces.

When surfaces of a machine or device rub against each other, a friction force results, along with wear in the surfaces. The wear reduces the ability of the machine or device to function properly and efficiently. The frictional resistance can be reduced in a number of manners, such as by changing the structure of the surface, the material used, and/or by adding a lubricant between the surfaces. Lubricants separate the sliding surfaces by forming a film, and thereby reduce the frictional resistance and wear. However, under load increases and increased sliding speed, many lubricants break down. In the case of oil-based lubricants, the oil heats up with increases in speed and pressure, causing the lubricant to break down. Further, many oil-based lubricants are not suitable for industries, such as the food and beverage industry, which require the lubricant to not contaminate the food that is produced.

Water is an attractive alternative to conventional lubricating oils. It has ecological, health, safety, and economic advantages as a lubricant, as well as excellent heat-transfer properties. Therefore water serves as a coolant to the sliding surfaces. However, it has the disadvantage of a low-pressure coefficient of viscosity, which decreases its ability to support high loads. Nature solves this problem by coating the sliding surfaces in vivo with a "smart" material, cartilage, that changes in response to pressure and holds on the surface immobilized chains of biomolecules, which can function as boundary lubricants.

Most of the literature concerning lubrication by aqueous media is divided into articles dealing with (1) biological lubrication in the human body (Jay G D et al., *J. Biomed. Mat. Res.,* 40(3): 414-418 (1998); Schwarz I M & Hills B A, *Brit. J. Rheumatology,* 37(1): 21-26 (1998); Smith A M A et al., Int. *J. STD & AIDS,* 9 (6): 330-335 (1998); Widmer M R et al., *Tribology Letters,* 10(1-2): 111-16 (2001); Xiong D S & Ge S R, *WEAR,* 250: 242-45 (2001)), (2) lubrication of ceramics (Basu B et al., *WEAR,* 250: 631-41(2001); Chen M et al., *Tribology Letters,* 11(1): 23-28 (2001); Francisco A et al., *Tribology Transactions,* 45(1): 110-16 (2002); Saito T et al., *WEAR,* 247(2): 223-30 (2001); Umehara N & Kato K, *J. Japan. Soc. Tribologists,* 42(11): 879-85 (1997)), geological effects involving water (Regenauer-Lieb K et al., *Science,* 294(5542): 578-80 (2001)), (3) hydraulic pumps (Wang D et al., *Indust. Lubric. and Tribology,* 53(5): 211-16 (2001)), and (4) oil-in-water emulsions (Ratoi-Salagean M et al., *Proceedings Inst. Mech. Engin. Part J: Journal Engin. Tribology,* 211(J3): 195-208 (1997) and Ratoi-Salagean M et al., *Tribology Transactions,* 40(4): 569-78 (1997)), or rubber tires on roads (Veith A G, *Rubber Chem. Technol.,* 69(5): 858-73 (1996)). However, relatively few articles address the use of a single-phase aqueous lubricant containing a boundary lubricating additive for the lubrication of metal contacts.

Plaza S et al., *WEAR,* 249 (12): 1077-89 (2001) describes a polyoxyethylene diphosphate derivative that appears to show some anti-wear and friction reduction activity in aqueous solution. At a load of 5N, all samples tested showed friction coefficients at 5N of around 0.1. Lei H et al., *WEAR,* 252(3-4): 345-50 (2002) describes a fullerene-styrene sulfonic acid copolymer, which shows low (0.3) friction coefficient at the lowest loads reported (100 N). The wear scar is shown to be very sulfur rich after the wear tests. Duan B & Lei H. *WEAR,* 249(5-6): 528-32 (2001) reports the use of colloidal polystyrene as an additive to aqueous fluids such as triethanolamine aqueous solution and a water-soluble zinc alkoxyphosphate (OPZ) solution. The addition of colloidal polystyrene to an aqueous base fluid appears to have a beneficial effect on the wear behavior of steel, as demonstrated by the maximum non-seizure load. However, the wear-scar diameter is not significantly reduced compared to the wear-scar diameter using a colloid-free solution, and no friction-reducing behavior is disclosed. Hollinger S et al., *Tribology Letters,* 9(3-4): 143-151 (2000) reports the use of vesicular and lamellar systems, suspended in phosphate-containing solutions, which appear to reduce friction in interfaces between brass and tungsten.

Multifunctional copolymers described in U.S. Pat. Nos. 5,462,990 and 5,627,233 and WO 98/47948 all to Hubbell et al. have been used in as surgical sealants and in analytical devices. U.S. Pat. Nos. 5,462,990 and 5,627,233 to Hubbell et al. discloses multifunctional polymeric materials for use in inhibiting adhesion and immune recognition between cells and tissues. The materials include a tissue-binding component (polyionic) and a tissue non-binding component. In particular, Hubbell discloses various PEG/PLL copolymers, with molecular weights greater than 300, with structures that include AB copolymers, ABA copolymers, and brush-type copolymers. These polymers are being commercially developed for use as tissue sealants and to prevent surgical adhesions. WO 98/47948 by Hubbell et al. describes grafted polyionic copolymers that are able to attach to biological and non-biological samples in order to control cell-surface and cell-cell and tissue-surface interactions in biomedical applications. WO 00/065352 by Hubbell et al. describes polyionic coatings in analytical and sensor devices, which promote specific recognition of a target analyte and at the same time minimize non-specific adsorption of other molecules in the sampling solution. However, these materials have never been used as lubricants.

There is a need for improved lubricating compositions. In particular there is a need for compositions which can reduce friction in metal oxide surfaces.

Therefore, it is an object of the invention to provide a stable polymeric material that can be added simply, quickly and cost-effectively to an aqueous medium to produce an environmentally friendly, aqueous lubricant.

It is a further object of the invention to coat metal oxide surfaces and other charged surfaces with a lubricating composition to reduce the friction coefficient and wear on the surfaces.

BRIEF SUMMARY OF THE INVENTION

Lubricating compositions, containing non-modified and modified multifunctional, polyionic copolymers and an aqueous lubricating media, and methods for making and using such compositions are described herein. The lubricating compositions are applied to metal oxide or other charged surfaces which are in contact with each other. The copolymers can serve as a surface protective boundary layer for the sliding surfaces, or they can also be used for the immobilization of further molecules, which can modify the tribological properties of the surfaces.

DETAILED DESCRIPTION OF THE INVENTION

I. Copolymers

Figure 1A:
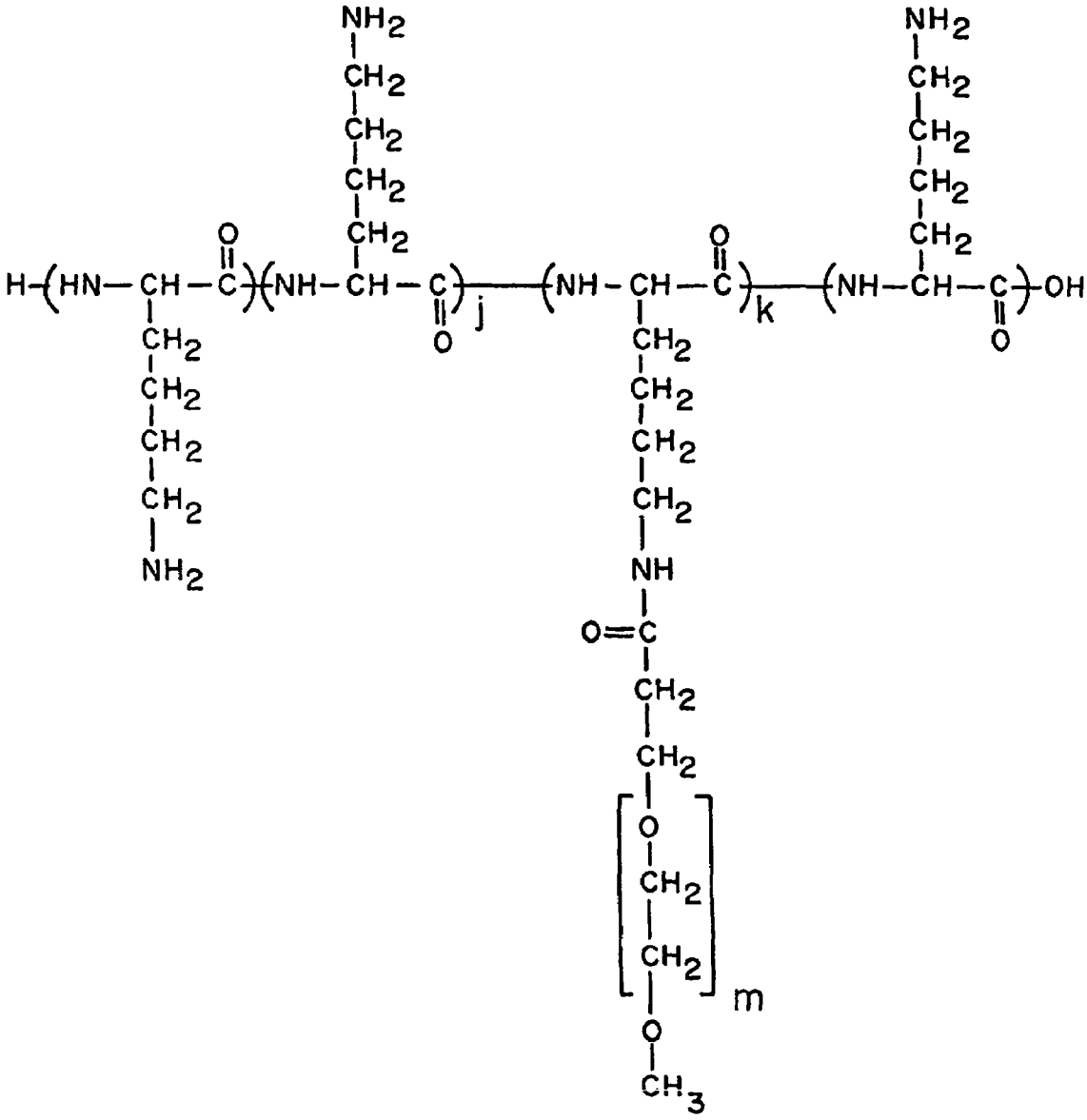
FIG. 1A depicts the chemical structure of a graft copolymer with a polycationic backbone, poly(L-lysine)-g-poly (ethylene glycol) (PEG-g-PLL), for surface modification of negatively charged surfaces.

The copolymers, are graft copolymers which contain a polyionic backbone, either polycationic or polyanionic, with non-interactive side chains, such as poly(ethylene glycol)-based side chains (see FIG. 1A). The copolymers are block copolymers. The copolymers may be in the form of: (1) brush copolymers (as in a bottle brush, with a backbone of one composition and bristles of another) with a backbone of poly (B) and bristles composed of poly(A), (A)x-b-(B)y; (2) AB block copolymers, i.e., (A)x(B)y, or a poly(A) connected at one end to a poly (B); and (3) ABA block copolymers, i.e., (A)x(B)y(A)z, or a poly(B) connected at both ends to poly(A) chains, or (B)x(A)y(3)z; where A is a monomer, the polymer of which does not bind strongly to a tissue; B is a monomer, the polymer of which does bind strongly to a tissue; x is an integer of greater than or equal to 5; y is an integer of greater than or equal to 3; and z is an integer greater than or equal to zero. Poly(A) and poly(B) are generally linear polymers, although both may be linear or branched. Both A and B can be monomers, macromers or polymers.

Suitable copolymers are described in U.S. Pat. Nos. 5,462,990 and 5,627,233 and WO 98/47948 all to Hubbell et al. U.S. Pat. Nos. 5,462,990 and 5,627,233 disclose multifunctional polymers, which include a tissue-binding component (polyionic) and a tissue non-binding component. In particular, Hubbell discloses PEG/PLL copolymers with molecular weights greater than 300 and structures that include AB copolymers, ABA copolymers, and brush-type copolymers. WO 98/47948 describes graft copolymers that attach to biological and non-biological samples to control cell-surface, cell-cell and tissue-surface interactions in biomedical applications. WO 00/065352 by Hubbell et al. describes polyionic coatings in analytical and sensor devices.

i. Polyionic Backbone

The backbone may be poly(cationic) or poly(anionic). Suitable poly(cationic) polymers have a net positive charge at neutral pH and include polyamines having amine groups on either the polymer backbone or the polymer sidechains, such as poly-L-lysine and other positively charged polyamino acids of natural or synthetic amino acids or mixtures of amino acids, including poly(D-lysine), poly(ornithine), poly(arginine), and poly(histidine), and nonpeptide polyamines such as poly(aminostyrene), poly(aminoacrylate), poly(N-methyl aminoacrylate), poly(N-ethylaminoacrylate), poly(N,N-dimethyl aminoacrylate), poly(N,N-diethylaminoacrylate), poly (aminomethacrylate), poly(N-methyl aminomethacrylate), poly(N-ethyl aminomethacrylate), poly(N,N-dimethyl aminomethacrylate), poly(N,N-diethyl aminomethacrylate), poly(ethyleneimine), polymers of quaternary amines, such as poly(N,N,N-trimethylaminoacrylate chloride), poly(methyacrylamidopropyltrimethyl ammonium chloride), and natural or synthetic polysaccharides such as chitosan.

Suitable polyanionic blocks include natural and synthetic polyamino acids having net negative charge at neutral pH. A representative polyanionic block is poly(glutamic acid), which contains carboxylic acid side chains with a negative charge at pH 7. Glycolic acid is just one example. It may be replaced by other natural or unnatural monomers that can be polymerized and contain a side functional group with negative charge at or near neutral pH, for example, any polymer having carboxylic acid groups attached as pendant groups. Suitable materials include alginate, carrageenan, furcellaran, pectin, xanthan, hyaluronic acid, heparin, heparan sulfate, chondroitin sulfate, dermatan sulfate, dextran sulfate, poly (meth)acrylic acid, oxidized cellulose, carboxymethyl cellulose and crosmarmelose, synthetic polymers and copolymers containing pendant carboxyl groups, such as those containing maleic acid or fumaric acid in the backbone. Polyaminoacids of predominantly negative charge are particularly suitable. Examples of these materials include polyaspartic acid, polyglutamic acid, and copolymers thereof with other natural and unnatural amino acids. Polyphenolic materials such as tannins and lignins can also be used. Preferred materials include alginate, pectin, carboxymethyl cellulose, heparin and hyaluronic acid.

Figure 1B:
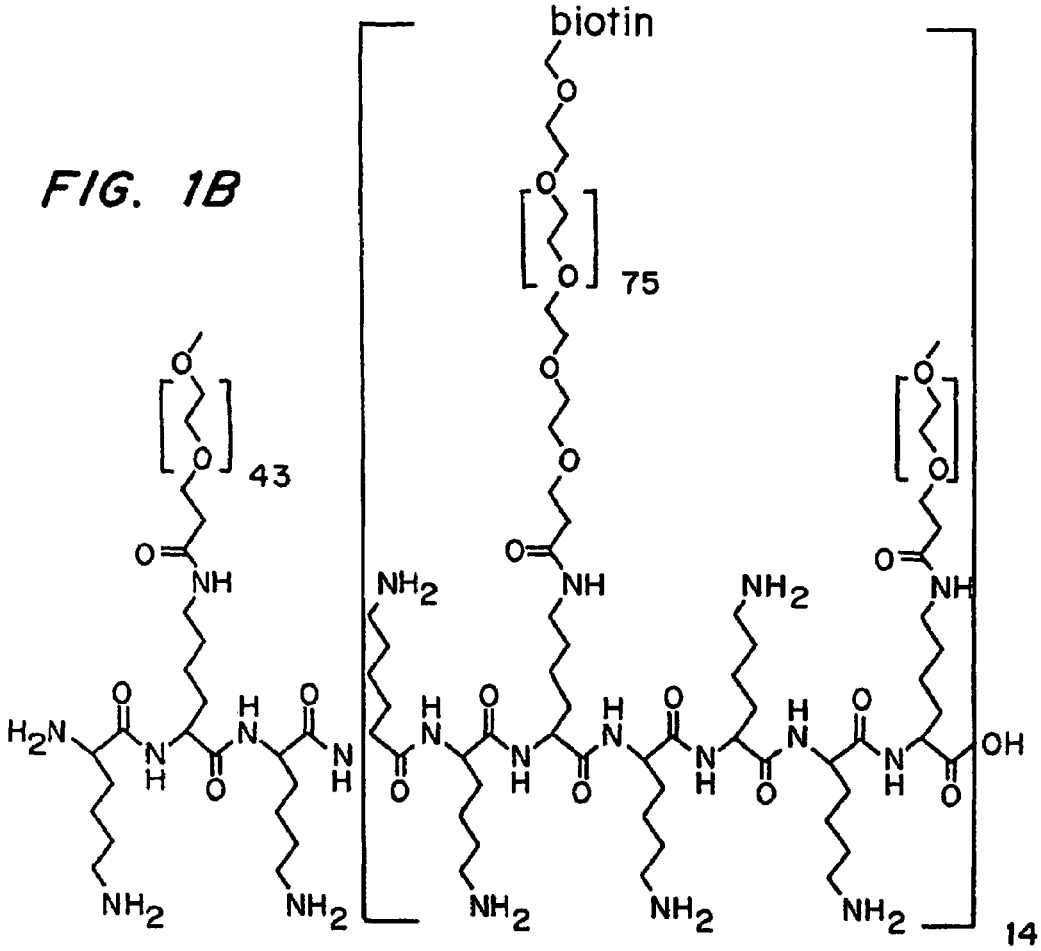
FIG. 1B depicts the chemical structure of a PEG-g-PLL polymer that is functionalized with biotin at the terminus of part of the PEG side chains.
Figure 1C:
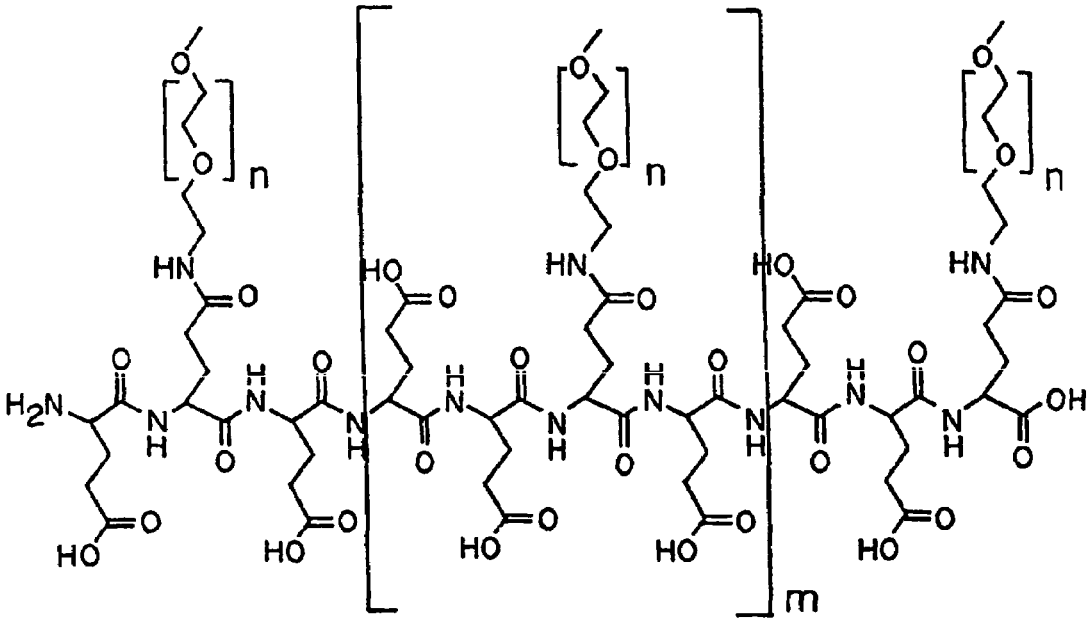
FIG. 1C depicts the chemical structure of a graft copolymer with a polyanionic backbone, poly(L-glutamic acid)-g-poly (ethylene glycol) (PEG-g-PLG), for surface modification of positively charged surfaces.
Figure 1D:
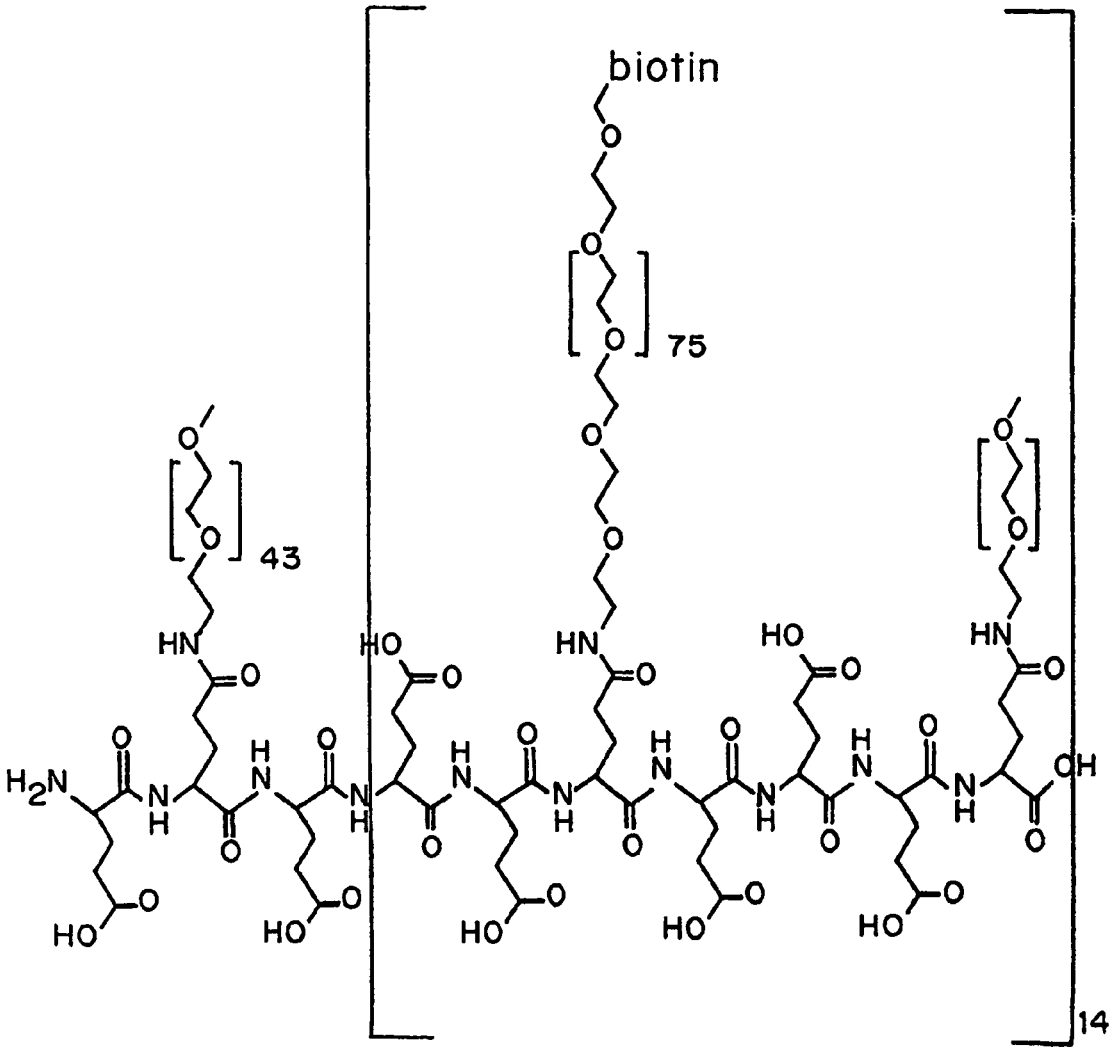
FIG. 1D depicts the chemical structure of a PEG-g-PLG polymer that is functionalized with biotin at the terminus of part of the PEG side chains.

The choice of positively charged (cationic) (see FIGS. 1A and 1B) or negatively charged (anionic) (see FIGS. 1C and 1D) backbone is based on the type of surface to which the copolymer is to be applied. Surfaces often possess a positive or negative charge when exposed to an aqueous environment. In particular, metal oxides (such as those present on a steel or titanium surface) or metal oxide coatings exposed to an aqueous solution spontaneously acquire a negative charge at pH above the isoelectric point (IEP) and positive charges at pH below the isoelectric point of the particular oxide chosen. For example, at pH 7 (neutral solution), niobium oxide ($Nb_2O_5$), tantalum oxide or titanium oxide ($TiO_2$) are all known to be negatively charged, while aluminum oxide at pH 7 is positively charged. The opposite charges of polymer and surface lead to a strong electrostatic binding of the polymer backbone to the surface, allowing the PEG chains to protrude into the solution, forming a lubricious coating.

ii. Non-Interactive Polymers

"Non-interactive" indicates that the polymer does not interact or bind with the metal oxide surfaces. Suitable non-interactive polymers include polyalkylene oxides, such as poly(ethylene glycol) (PEG), mixed polyalkylene oxides having a solubility of at least one gram/liter in aqueous solutions such as some poloxamer nonionic surfactants, neutral water-soluble polysaccharides, polyvinyl alcohol, poly-N-vinyl pyrrolidone, non-cationic poly(meth)acrylates, many neutral polysaccharides, including dextran, ficoll, and derivatized celluloses, such as hydroxy ethyl cellulose, polyvinyl alcohol, non-cationic polyacrylates, such as poly(meth) acrylic acid, and esters amide and hydroxyalkyl amides thereof, and neutral poly(amino acids) such as poly(serine), poly(threonine), and poly(glutamine) and copolymers of the monomers thereof, and combinations thereof.

In the preferred embodiment, the non-interactive polymer is poly(ethylene glycol) (PEG). PEG chains are highly water-soluble and highly flexible. PEG chains have an extremely high motility in water and are essentially non-ionic in structure. The PEG chains are grafted onto the polyionic backbone to form a copolymer.

iii. Modified Copolymers

The copolymer can be modified by introducing functional groups at or near the terminal (free end) position of the side chains. These groups allow further functionalization and incorporation of species that have an additional beneficial effect on the tribological behavior. In one embodiment, bioactive molecules, such as biotin, are added to the terminal end of the PEG chains (see e.g. FIGS. 1B and 1D). Other linker species, such as thiol, NTA (for binding to histidine-tags via Ni ions), and vinylsulfone can also be used.

A modified copolymer has three functions: (1) charged sites in the backbone used to attach the molecule to oppositely charged substrate surfaces (called 'substrate attachment function'), (2) grafted side chains that form a dense structure, such as a brush, to make the surface lubricious, and (3) functional groups that allow the incorporation of further molecules, which have advantageous tribological properties.

Non-modified and modified copolymers can be used singly, consecutively or as a mixture.

iv. Aqueous Solutions

The aqueous solution may be a lubricant, such as water or buffer solutions such as HEPES. Other additives, such as compounds which inhibit rust and corrosion, may also be present.

II. Methods of Making the Lubricant Compositions

The copolymers are dissolved in an aqueous medium at a low concentration. The polymers are added to form a solution with a concentration of 0.1 g/liter to 10 g/liter. In a preferred embodiment, the concentration range is 0.25 g/liter to 2 g/liter.

Additives to prevent corrosion and rust may be present in the solution.

III. Methods of Using the Lubricant Compositions

Figure 2:
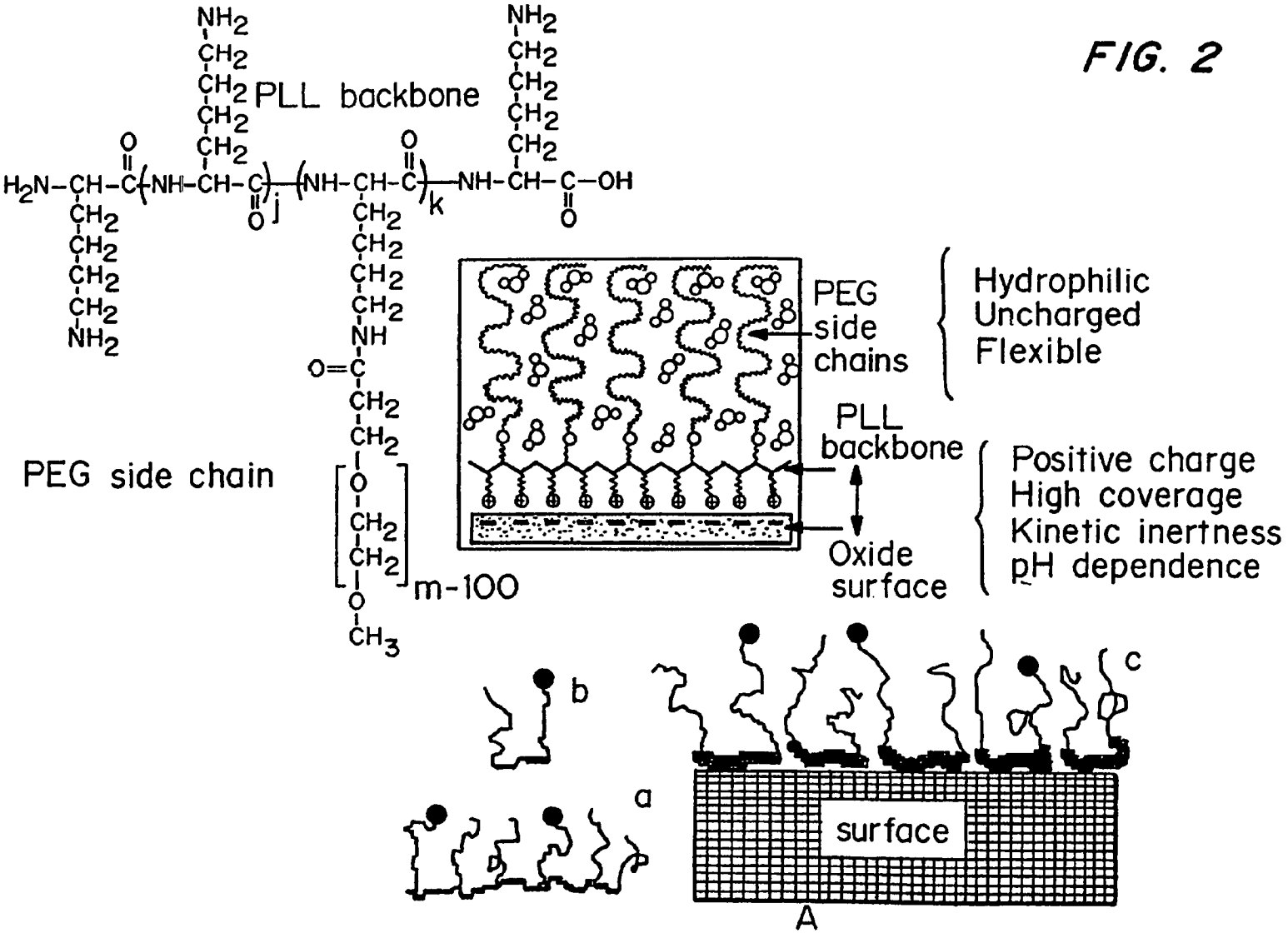
FIG. 2 is a pictorial representation of multifunctional polymers adsorbed on to a surface. The top portion of FIG. 2 contains the chemical structure of PLL-PEG and a pictorial representation of PLL-PEG adsorbing onto a negatively charged oxidic surface. The bottom portion of FIG. 2 contains a pictorial representation of graft copolymers (a) and block copolymers (b) formed from cationic components (heavy line) and poly(ethylene glycol) (light line). The dots at the ends of the light line represent specific molecules, which can be attached to the tips of the PEG chains.

The lubricant compositions may be applied to charged surfaces to form a lubricious coating on the surfaces. This results in a lower friction coefficient between two sliding surfaces under boundary lubrication conditions, as well as the protection of the surfaces from wear. As shown in FIG. 2, the charged backbone of the copolymers adsorbs onto the surface, while the PEG sidechains generally extend away from the surface. The PEG sidechains may be modified to contain functional molecules (depicted as dots in FIG. 2) at the end of the chain which allow for the specific interaction with other molecules.

Any system where a metal oxide film is present, such as steel, aluminum, titanium, glass, silicon, may be coated with the lubricant compositions. Such systems favor aqueous solutions over oil-based ones. Devices or machines used in the textile or food and beverage industry, for example, where contamination from oil is a problem, may be coated with the lubricant compositions.

The present invention will be further understood by reference to the following non-limiting examples.

EXAMPLES

Example 1

Adsorption of PLL(375)-g[5.6]-PEG(5) on Metal Oxide Surfaces

PLL(375)-g[5.6]-PEG(5) or PLL(20)-g[3.4]-PEG(2) was added to 10 mM organic buffer, 4-(2-hydroxyethyl)piperizine-1-ethanesulfonic acid) (HEPES) at pH 7.4, to form a 1 mg/mL polymer solution. Measurements were taken by the optical waveguide lightmode spectroscopy (OWLS) method.

Figure 3:
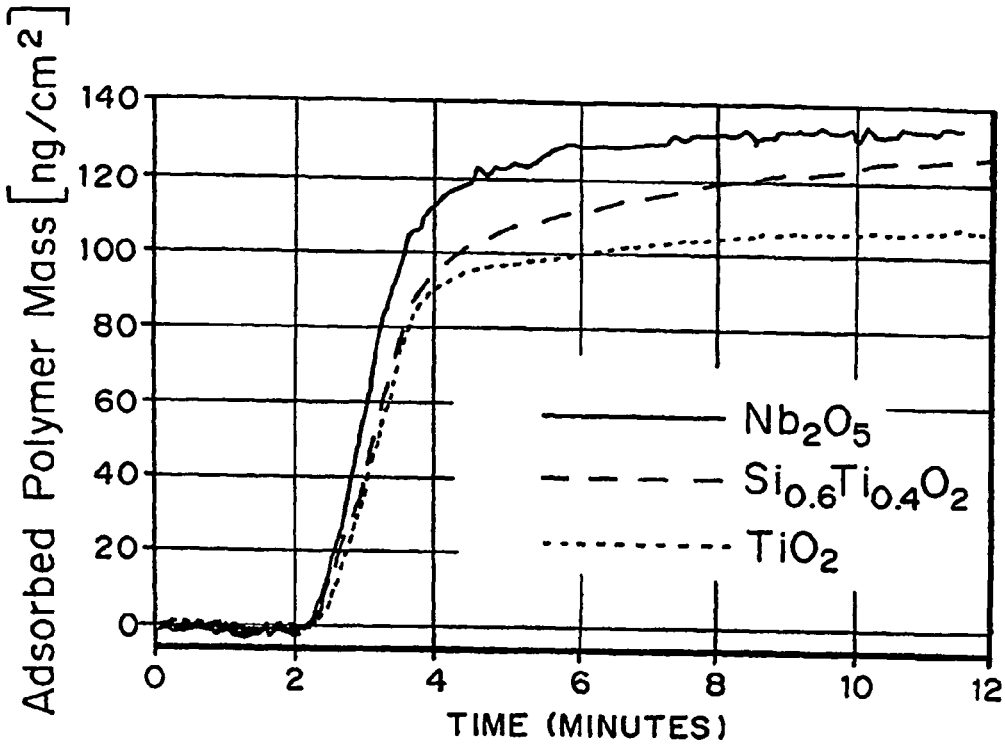
FIG. 3 is a graph of time (minutes) versus amount of PLL(375)-g[5.6]-PEG(5) (ng/cm$^2$) adsorbed on three different metal oxide surfaces ($Nb_2O_5$, $Si_{0.6}Ti_{0.4}O_2$, and $TiO_2$).
Figure 4:
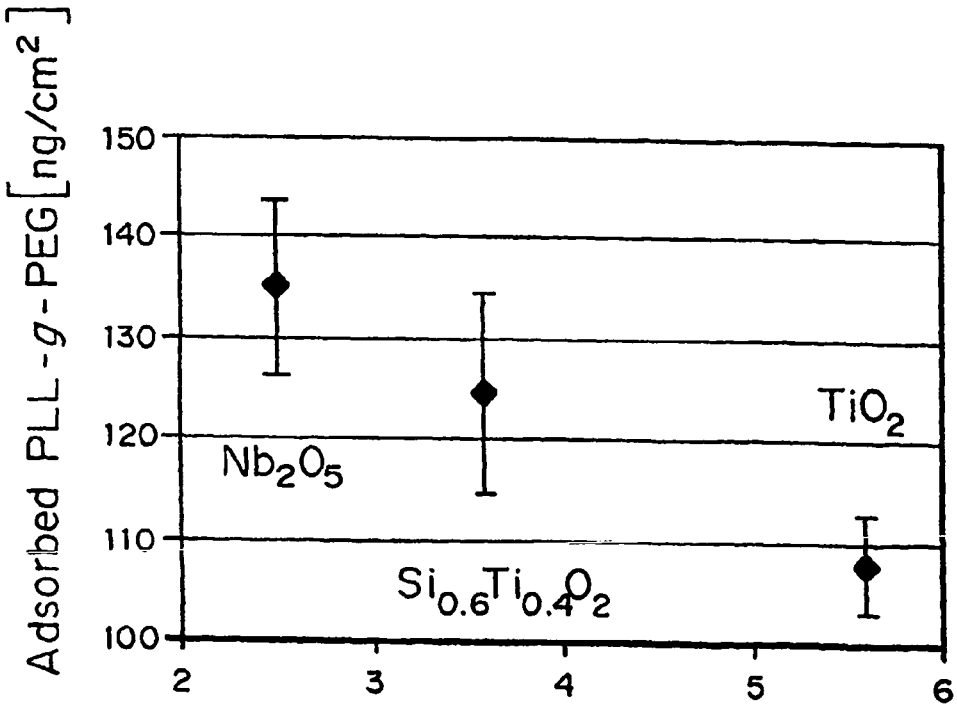
FIG. 4 is a graph of isoelectric point versus amount of adsorbed polymer, PLL(375)-g[5.6]-PEG(5), (ng/cm$^2$) for three different metal oxide surfaces ($Nb_2O_5$, $Si_{0.6}Ti_{0.4}O_2$, and $TiO_2$).

FIG. 3 displays the uptake of PLL(20)-g[3.4]-PEG(2) solutions on a steel surface (magnetron sputtered onto a waveguide surface) as a function of time, thereby showing that the polymer attaches itself to the surface, forming a surface coverage of some 200 ng/cm$^2$ after a short period. FIG. 4 displays the total uptake of PLL(375)-g[5.6]-PEG(5) on several oxides surfaces, showing the dependence of the amount of uptake on the isoelectic point of the oxide surface.

Example 2

Lubrication of Steel Pin Against Glass with PLL-g-PEG Copolymers (Sliding Geometry)

Two different architectures of PLL-PEG (PLL(20)-g[3.4]-PEG(2) and PLL(20)-g[3.4]-PEG(5)) were dissolved in HEPES at a concentration of 0.25 g/liter and used to lubricate a couple consisting of a steel pin and glass. The steel is covered with its native oxide.

Figure 5:
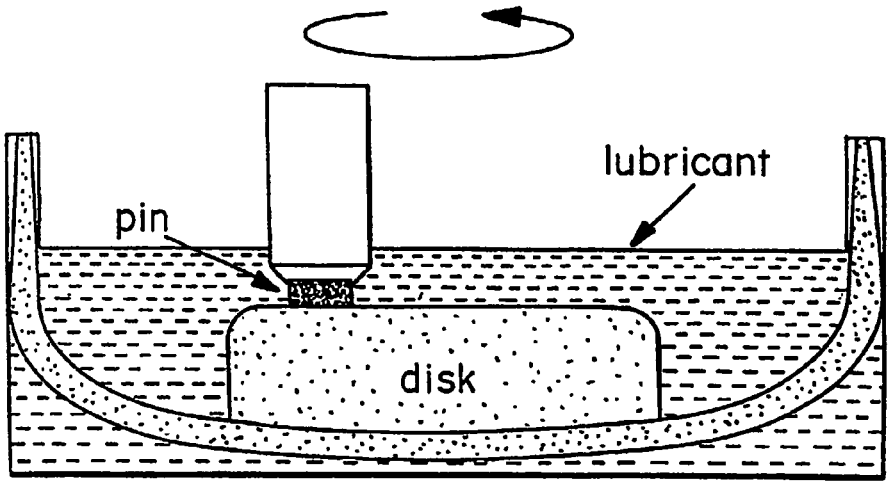
FIG. 5 is a pictorial representation of the pin-on-disk, sliding geometry used in testing the lubricant formulations. The dotted area designates the lubricant formulation. The dark, shaded rectangle designates the pin.

The contact geometry for testing lubricant formulations is shown in FIG. 5. The lubricant was placed on the surface of the glass and the steel pin was then placed on top of the glass and the glass disk rotated to create a sliding motion between the two surfaces. The glass and the pin were also tested in a polymer-free buffer.

Figure 6:
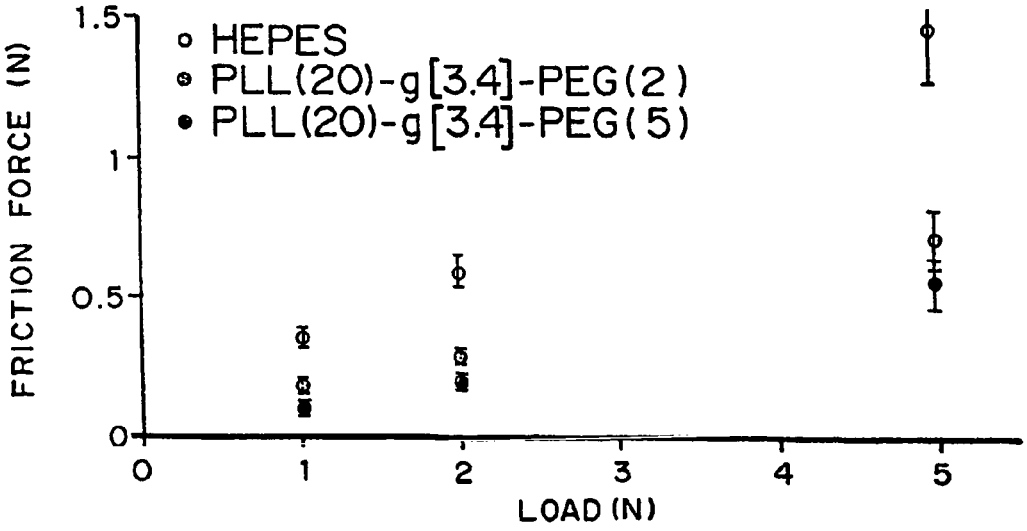
FIG. 6 is a graph of friction force (N) versus load (N), used to determine friction coefficients for two different architectures of PLL-PEG, (1) PLL(20)-g(3.4)-PEG(2) and (2) PLL (20)-g[3.4]-PEG(5), as boundary lubricant additives for a steel-glass sliding couple.

In FIG. 6, the sliding-friction-reduction effect of the added polymer is seen when the polymer-containing solution is compared to the polymer-free buffer. The friction coefficient (μ) of buffer (0.28) is reduced to a value of 0.13 for PLL(20)-g[3.4]-PEG(2) and to a value of 0.11 for PLL(20)-g[3.4]-PEG (5). Thus, a friction-reducing effect is observed. These results also indicate that the reduction in friction increases as the length of the side chains (e.g. PEG) increases.

Example 3

Figure 7:
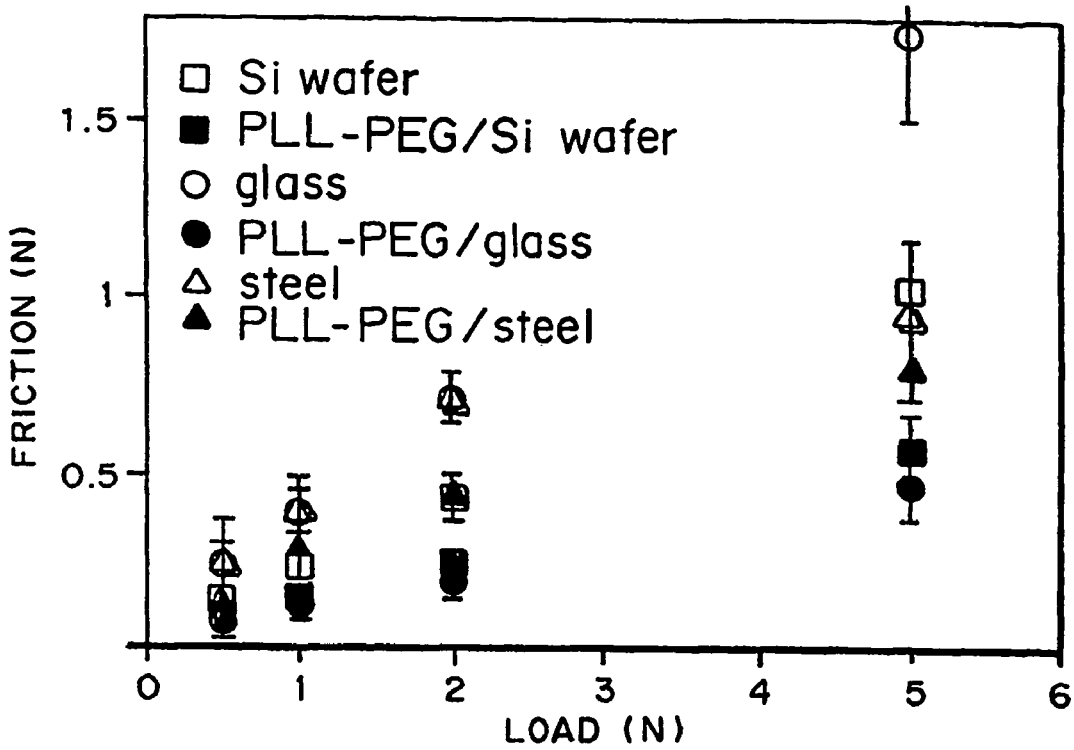
FIG. 7 is a graph of load (N) versus friction force (N), used to determine friction coefficients for various sliding couples in the presence of PLL(20)-g(2.1)-PEG(2) in HEPES at concentration of 0.25 g/liter. A force of 2 Newtons was applied. A steel pin was used in each experiment. The different sliding surfaces were silicon wafer (squares), glass (circles), and steel (triangles).

Lubrication of Three Different Sliding Pairs, Steel-Glass, Steel-Silicon, and Steel-Steel, with PLL-PEG Graft Copolymer The PLL(20)-g(2.1)-PEG(2), polymer was added to HEPES at 0.25 g/liter. A steel pin was used in each experiment, and a force of 2 Newtons was applied. The contact geometry for testing the lubricant formulation is shown in FIG. 5. The friction-reducing effect observed on three different sliding pairs, steel-glass, steel-silicon, and steel-steel (FIG. 7). The friction-reduction effects are noticeable on all three couples. For the steel-silicon couple, the friction coefficient decreased from 0.21 without the polymer to 0.12 with the polymer solution. For the steel-glass couple, the friction coefficient reduced even more drastically, from 0.36 without the polymer to 0.09 with the polymer solution. For the steel-steel couple, the friction coefficient was reduced from 0.36 without the polymer to 0.22 with the polymer solution.

Example 4

Lubrication of Steel Ball Against Glass with PLL-g-PEG Copolymers (Rolling Geometry)

Two different architectures of PLL-PEG (PLL(20)-g[3.4]-PEG(2) and PLL(20)-g[3.4]-PEG(5)) were dissolved in HEPES at a concentration of 0.25 g/liter and used to lubricate a couple consisting of a steel pin and soda glass. The steel was covered with its native oxide.

Figure 8:
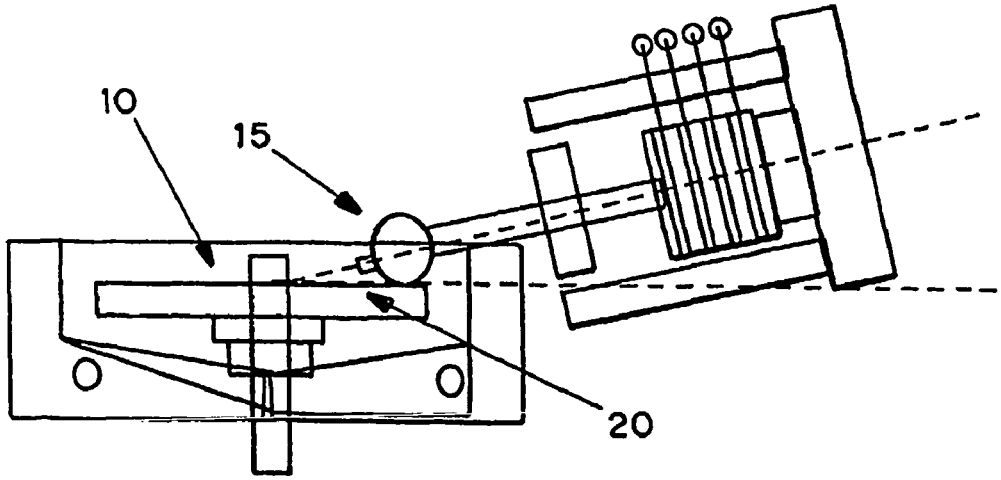
FIG. 8 is a pictorial representation of the ball-on-disk geometry used in testing the lubricant formulations in rolling geometry.

The contact geometry for testing lubricant formulations is shown in FIG. 8. The lubricant was placed on the surface (10) of the glass disk and the steel ball (15) was then placed on top of the glass. The glass disk (20) and the steel ball (15) were both rotated, creating a mixed rolling/sliding contact, with a slide/roll ratio of 10 (chiefly rolling). The glass (20) and the ball (10) were also tested in a polymer-free buffer (HEPES).

Figure 9:
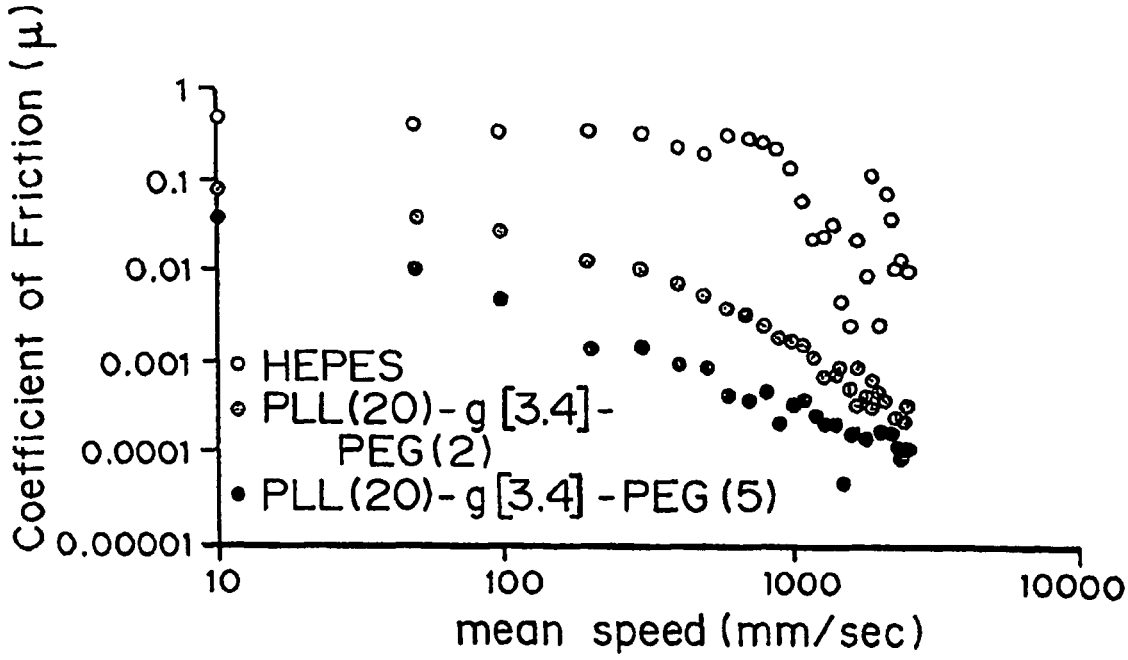
FIG. 9 is a graph of mean rolling speed (mm/sec) versus friction coefficient (μ) for pure buffer (HEPES), PLL(20)-g [3.4]-PEG(2) and PLL(20)-g[3.4]-PEG(5) for a steel ball rolling on a glass disk at a slide-roll ratio of 10.

The results of this test are shown in FIG. 9. The friction-reduction effect of the added polymer is compared to the performance of pure buffer. A friction-coefficient-reduction effect of greater than two orders of magnitude was observed when polymer was added to the buffer. Further, the longer PEG chains (PLL(20)-g[3.4]-PEG(5)) provided nearly an extra order of magnitude effect over the short-chain version of the polymer (PLL(20)-g[3.4]-PEG(2)).

It is understood that the disclosed invention is not limited to the particular methodology, protocols, and reagents described as these may vary. It is also to be understood that the terminology used herein is for the purpose of describing particular embodiments only, and is not intended to limit the scope of the present invention, which will be limited only by the appended claims.

We claim:

1. A method of lubricating two sliding surfaces, wherein the two sliding surfaces slide against each other and are in a device or machine, wherein at least one surface is a charged surface, comprising administering between the two surfaces a lubricating composition, wherein the lubricating composition comprises a graft copolymer comprising a polyionic backbone that has a net positive or negative charge at neutral pH and side chains, and an aqueous medium, wherein the side chains are formed by a polymer consisting of a first monomer (A), wherein the polyionic backbone is formed by a polymer consisting of a second monomer (B), wherein the polyionic backbone adsorbs onto the charged surface to produce a lubricated surface, wherein the side chains do not bind with the charged surface, and wherein the resulting lubricated surface has a lower friction coefficient between the lubricated surface and the second sliding surface than the coefficient of friction between the charged surface and the second sliding surface in the absence of the lubricating composition.

2. The method of claim 1, wherein the polyionic backbone is poly(cationic).

3. The method of claim 2, wherein the polyionic backbone is selected from the group consisting of nonpeptide polyamines, polyamino acids and polysaceharides having net positive charge at neutral pH.

4. The method of claim 3, wherein the polyionic backbone is poly-L-lysine.

5. The method of claim 1, wherein the polyionic backbone is poly(anionic).

6. The method of claim 5, wherein the polyionic backbone is a polyamino acid having net negative charge at neutral pH.

7. The method of claim 6, wherein the polyamino acid is poly(L-glutamic acid).

8. The method of claim 1, wherein the side chains are poly(ethylene glycol) chains.

9. The method of claim 1, wherein the charged surface is a metal oxide.

10. A device or machine comprising two sliding surfaces, wherein the two sliding surfaces slide against each other when in operation, wherein at least one surface is a lubricated surface, comprising a charged surface and a lubricating composition, wherein the lubricating composition comprises a graft copolymer comprising a polyionic backbone that has a net positive or negative charge at neutral pH and side chains, and an aqueous medium, wherein the polyionic backbone adsorbs onto the charged surface, wherein the side chains do not bind with the charged surface, and wherein the lubricated surface has a lower friction coefficient between the lubricated surface and the second sliding surface than the coefficient of friction between the charged surface and the second sliding surface in the absence of the lubricating composition.

11. The device or machine of claim 10, wherein the graft copolymer is PLL-g-PEG.

12. The device or machine of claim 10, wherein the charged surface is a metal oxide.

13. The method of claim 1, wherein the charged surface is oxidized silicon.

14. The device or machine of claim 10, wherein the charged surface is oxidized silicon.

15. The device or machine of claim 10, wherein the polyionic backbone is selected from the group consisting of nonpeptide polyamines, polyamino acids and polysaccharides having net positive charge at neutral pH.

16. The device or machine of claim 10, wherein the side chains are formed by a first polymer consisting of a first monomer (A), and wherein the polyionic backbone is formed by a second polymer consisting of a second monomer (B).

17. The method of claim 1, wherein the side chains are neutral water-soluble polysaceharides.

18. The method of claim 17, wherein the neutral water-soluble polysaceharides comprise dextran.

19. The device or machine of claim 10, wherein the side chains are neutral water-soluble polysaccharides.

20. The device or machine of claim 19, wherein the neutral water-soluble polysaccharides comprise dextran.

* * * * *